US008760067B2

(12) United States Patent
Burrows

(10) Patent No.: US 8,760,067 B2
(45) Date of Patent: Jun. 24, 2014

(54) SYSTEM AND METHOD FOR CONTROLLING ARC FORMATION IN A CORONA DISCHARGE IGNITION SYSTEM

(75) Inventor: John Antony Burrows, Northwich (GB)

(73) Assignee: Federal-Mogul Ignition Company, Southfield, MI (US)

( * ) Notice: Subject to any disclaimer, the term of this patent is extended or adjusted under 35 U.S.C. 154(b) by 80 days.

(21) Appl. No.: 13/438,127

(22) Filed: Apr. 3, 2012

(65) Prior Publication Data

US 2012/0249006 A1 Oct. 4, 2012

Related U.S. Application Data

(60) Provisional application No. 61/471,448, filed on Apr. 4, 2011, provisional application No. 61/471,452, filed on Apr. 4, 2011.

(51) Int. Cl.
*H01T 15/00* (2006.01)

(52) U.S. Cl.
USPC ..... 315/209 T; 315/291

(58) Field of Classification Search
None
See application file for complete search history.

(56) References Cited

U.S. PATENT DOCUMENTS

| | | | | |
|---|---|---|---|---|
| 5,144,207 | A * | 9/1992 | Brunson | 315/291 |
| 5,568,801 | A | 10/1996 | Paterson et al. | |
| 5,654,868 | A * | 8/1997 | Buer | 361/256 |
| 6,085,733 | A | 7/2000 | Motoyama et al. | |
| 2004/0129241 | A1 | 7/2004 | Freen | |
| 2010/0055455 | A1 | 3/2010 | Dauer et al. | |
| 2010/0147239 | A1 | 6/2010 | Lu et al. | |
| 2010/0251995 | A1 | 10/2010 | Nouvel et al. | |
| 2010/0282198 | A1 | 11/2010 | Hampton et al. | |
| 2011/0114071 | A1 | 5/2011 | Freen | |
| 2011/0197865 | A1 * | 8/2011 | Hampton | 123/623 |
| 2011/0203543 | A1 | 8/2011 | Agneray et al. | |
| 2011/0297132 | A1 | 12/2011 | Schremmer et al. | |
| 2011/0305998 | A1 | 12/2011 | Toedter et al. | |
| 2012/0048225 | A1 | 3/2012 | Makarov et al. | |
| 2012/0055430 | A1 | 3/2012 | Braeuchle | |

FOREIGN PATENT DOCUMENTS

| | | | |
|---|---|---|---|
| FR | 2859831 | A1 | 9/2012 |
| WO | 2010011838 | A1 | 1/2010 |

OTHER PUBLICATIONS

International Search Report PCT/US2012/032036 mailed on Sep. 11, 2012.

* cited by examiner

*Primary Examiner* — Crystal L Hammond
(74) *Attorney, Agent, or Firm* — Robert L. Stearns; Dickinson Wright, PLLC

(57) ABSTRACT

A system and method for controlling an arc formation in corona discharge ignition system is provided. The system includes a corona igniter for receiving energy at a voltage and providing a corona discharge. An energy supply providing the energy to the corona igniter at a voltage. The system also includes a corona controller for initiating a decrease in the voltage of the energy provided to the corona igniter in response to the onset of arc formation. The voltage is decreased until the arcing is depleted, and then the voltage is increased again to resume the corona discharge. Controlling the arc formation provides improved energy efficiency during operation of the corona discharge ignition system.

17 Claims, 4 Drawing Sheets

SYSTEM AND METHOD FOR CONTROLLING ARC FORMATION IN A CORONA DISCHARGE IGNITION SYSTEM

CROSS REFERENCE TO RELATED APPLICATION

This application claims the benefit of U.S. provisional application Ser. Nos. 61/471,448 and 61/471,452, both filed Apr. 4, 2011.

BACKGROUND OF THE INVENTION

1. Field of the Invention

This invention relates generally to corona discharge ignition systems, and more particularly to controlling arc formation in the system.

2. Related Art

Corona discharge ignition systems provide an alternating voltage and current, reversing high and low potential electrodes in rapid succession which makes arc formation difficult and enhances the formation of corona discharge. The system includes a corona igniter with a central electrode charged to a high radio frequency voltage potential and creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, metal shell, or other portion of the igniter. The electric arc, or arcing, can reduce energy efficiency and decrease the robustness of the ignition event of the system. An example of a corona discharge ignition system is disclosed in U.S. Pat. No. 6,883,507 to Freen.

SUMMARY OF THE INVENTION

One aspect of the invention provides a method for controlling an arc formation in a corona discharge ignition system. The method includes providing energy to a corona igniter at a voltage; and decreasing the voltage of the energy provided to the corona igniter in response to an arc formation.

Another aspect of the invention provides a system employing the method. The system includes the corona igniter for receiving energy at a voltage and providing the corona discharge, and an energy supply for providing the energy to the corona igniter at a voltage. The system also includes a corona controller for initiating a decrease in the voltage of the energy provided to the corona igniter in response to the arc formation. Controlling the arc formation provides improved energy efficiency during operation of the corona discharge ignition system, improved durability of such a system, and may provide improved ignition performance.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

The invention provides a system and method for controlling an unintentional arc formation in an ignition system designed to provide a corona discharge 20. The system includes a corona igniter 22 for receiving energy at a voltage and providing the corona discharge 20 and an energy supply 24 for providing the energy to the corona igniter 22 at the voltage. The system also includes an corona controller 26 for initiating a decrease in the voltage of the energy provided to the corona igniter 22 in response to an arc formation occurring after the corona discharge 20 is provided. The method employed in the system includes providing energy to the corona igniter 22 at a voltage; and decreasing the voltage of the energy provided to the corona igniter 22 in response to an arc formation.

The system and method provides several advantages over prior art systems used to control arcing. First, the system and method is low cost as it can use components of an calibration, or monitoring. Further, the system and method is extremely fast and can control arcing after the onset of the arc formation in a matter of nanoseconds or microseconds. Although the system and method is designed to provide corona discharge, it does not try to prevent the onset of arc formation. However, the arc formation is controlled and preferably extinguished if it does occur. Controlling the arc formation provides improved energy efficiency during operation of the corona discharge ignition system.

Figure 1:
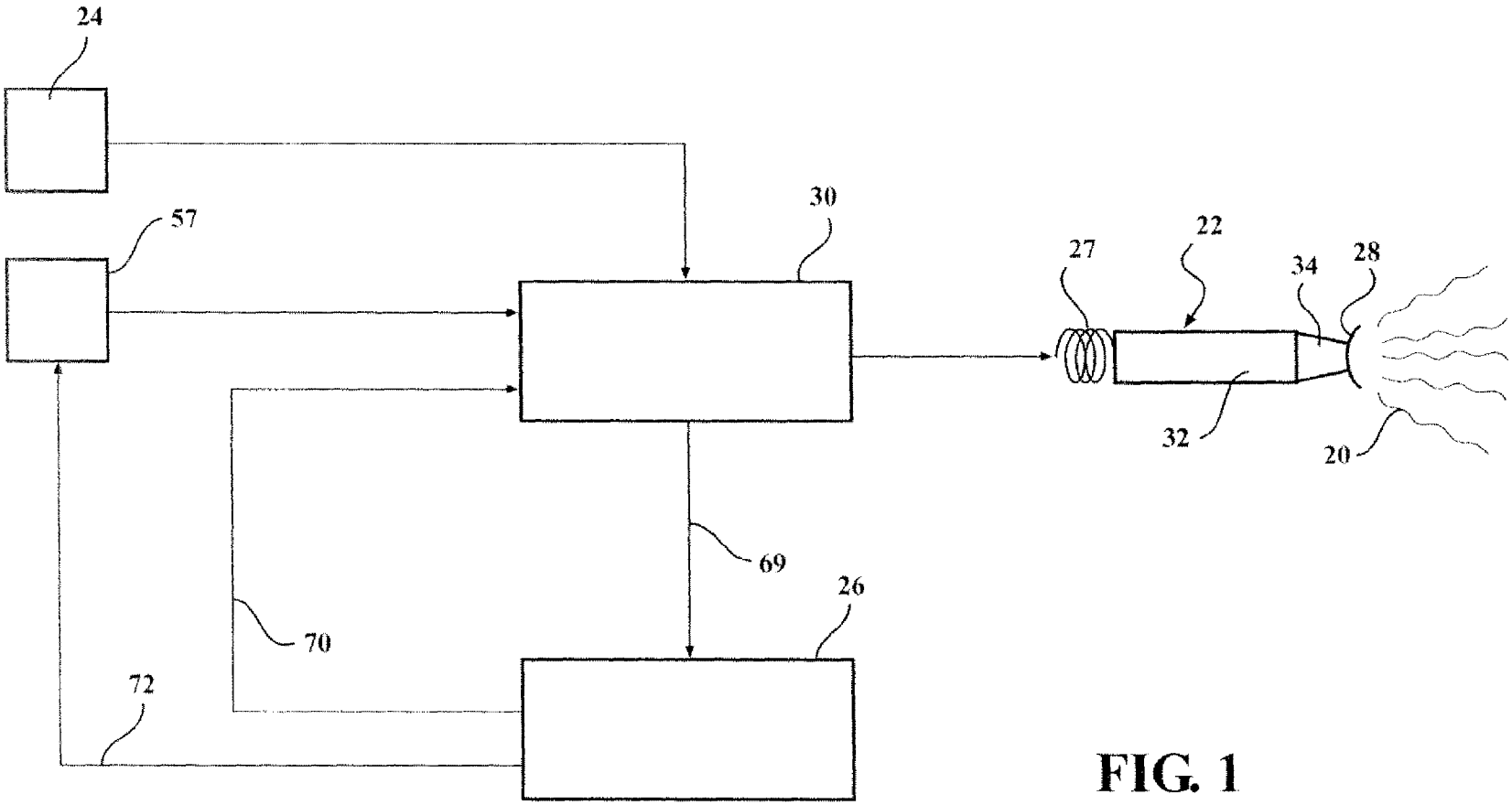
FIG. 1 is a block diagram of a system for controlling an arc formation according to one embodiment of the invention.

The system is typically employed in an internal combustion engine (not shown). The internal combustion engine includes a cylinder head, cylinder block, and piston defining a combustion chamber containing a combustible mixture of fuel and air. The corona igniter 22 is received in the cylinder head and includes an ignition coil 27 and a central electrode with a corona tip 28, shown in FIG. 1, extending into the combustion chamber. The energy supply 24 stores the energy and provides the energy to a driver circuit 30 and ultimately to the corona igniter 22. The ignition coil receives energy from the energy supply 24 at a high radio frequency voltage, stores some of the energy, and then transmits the energy to the central electrode. In one embodiment, the ignition coil 27 receives the energy at a level up to 100,000 volts, a current below 5 amperes, and a frequency of 0.5 to 2.0 megahertz. The central electrode then emits a radio frequency electric field into the combustion chamber to ionize a portion of the fuel-air mixture and provide the corona discharge 20 in the combustion chamber. The corona igniter 22 typically includes an insulator 32 surrounding the central electrode, and the insulator 32 and central electrode are received in a metal shell 34, as shown in FIG. 1.

Figure 2:
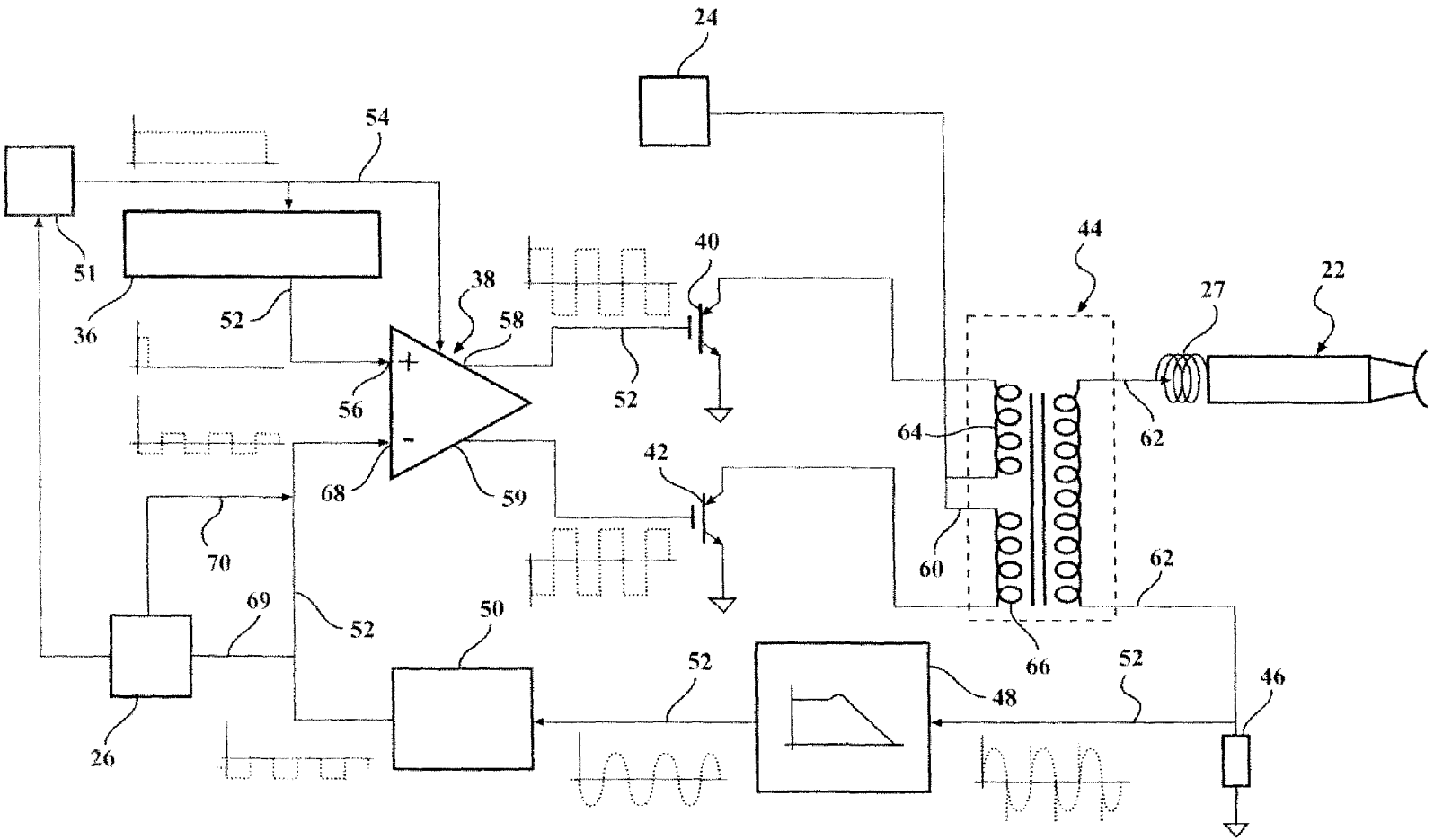
FIG. 2 is another block diagram of a system for controlling an arc formation showing components of a driver circuit according to another embodiment of the invention.

FIG. 2 is a block diagram showing the corona ignition system and components of the driver circuit 30 according to one embodiment of the invention. The driver circuit 30 includes a trigger circuit 36, a differential amplifier 38, a first switch 40, a second switch 42, a transformer 44, a current sensor 46, a low pass filter 48, and a clamp 50. The energy provided to the driver circuit 30 oscillates at the resonant frequency during operation of the corona ignition system. FIG. 2 shows the energy being transmitted in signals 52 between the components. FIG. 2 also includes a graph of the energy current between each of the components.

A main controller 51 of the engine control unit (not show) typically provides an enable signal 54 which turns on the differential amplifier 38. The trigger circuit 36 then initiates the oscillation of frequency and voltage of the energy flowing through the system to and from the corona igniter 22 in response to the enable signal 54. The trigger circuit 36 initiates the oscillation by creating a trigger signal 52 and transmitting the trigger signal 52 to the differential amplifier 38. The system has a period of resonance, and the trigger signal 52 is typically less than half of the period of resonance.

The differential amplifier 38 is activated upon receiving the trigger signal 52. The differential amplifier 38 then receives the energy at a positive input 56, amplifies the energy, and transmits the energy from a first output 58 and a second output 59.

The first switch 40 of the driver circuit 30 is enabled by the first output 58 of the differential amplifier 38, and directs the energy from the energy supply 24 to the corona igniter 22. The switches 40, 42 can be BJT, FET, IGBT, or other suitable types.

The transformer 44 of the driver circuit 30 includes a transformer input 60 for receiving the energy and transformer output 62 for transmitting the energy from the energy supply 24 to the corona igniter 22 and to the current sensor 46. The transformer 44 includes a primary winding 64 and secondary winding 66 transmitting the energy therethrough. The energy from the energy supply 24 first flows through the primary winding 64, which causes the energy to flow through the secondary winding 66. The components of the corona igniter 22 together provide the LC circuit of the system, also referred to as a resonant circuit or tuned circuit. By detection of the resonating current at sensor 46, the resonant frequency of the system is equal made to the resonant frequency of the LC circuit.

The current sensor 46 is typically a resistor and measures the current of energy at the output of the transformer 44 and the corona igniter 22. The current of energy at the output of the transformer 44 is typically equal to the current of energy at the corona igniter 22. The current sensor 46 then transmits the energy to the low pass filter 48. The low pass filter 48 removes unwanted frequencies and provides a phase shift in the current of energy. The phase shift is typically not greater than 180°.

The clamp 50 receives the energy from the low pass filter 48 and performs a signal conditioning on the current of energy. The signal conditioning can include converting the current of energy to a square wave and to a safe voltage. The clamp 50 then transmits the energy back to the negative input 68 of the differential amplifier 38.

FIG. 2 shows the corona controller 26 between the clamp 50 and the differential amplifier 38, however it can be disposed in other locations in the system. Further, the corona controller 26 is shown in FIGS. 1 and 2 as a separate component, but may be coupled to or integrated integral with another component of the system. The onset of the arc formation is not intentionally prevented, but the system is typically designed to provide corona discharge 20, and therefore the onset of the arc formation is unintentional. The arc formation can be detected by a variety of different methods. It can be detected by the corona controller 26 or by a separate component. If the arc formation is detected by another component a notification signal 69 is transmitted to the corona controller 26.

Once the arc formation is detected, the corona controller 26 initiates a decrease in the voltage of the energy provided to the corona igniter 22. In one embodiment, the corona controller 26 initiates the voltage decrease by disabling the differential amplifier 38, or preventing the differential amplifier 38 from providing the energy to the corona igniter 22. The corona controller 26 can disable the differential amplifier 38 by sending a command signal 70 to the driver circuit 30, as shown in FIGS. 1 and 2. In another embodiment, the corona controller 26 initiates the voltage decrease by stopping the enable signal 54 provided by the main controller 26. In this case, the corona controller 26 sends a feedback signal 72 to the main controller 51, also shown in FIGS. 1 and 2. Once the main controller 26 receives the feedback signal 72 and stops the enable signal 54, the energy supply 24 decreases the voltage of the energy supplied to the corona igniter 22 or stops supplying the energy to the corona igniter 22.

The step of decreasing the voltage of the energy provided to the corona igniter 22 in response to an arc formation includes decreasing the voltage of the energy by at least 10%. For example, if the voltage provided to the corona igniter 22 is 40,000 volts, the voltage would be decreased to 36,000 volts or less. In one embodiment, the step of decreasing the voltage of the energy provided to the corona igniter 22 includes ceasing the step of providing energy to the corona igniter 22, such that no energy is provided to the corona igniter 22. Once energy supply is resumed, it may be at a lower level as previously described.

The step of decreasing the voltage of the energy provided to the corona igniter 22 in response to an arc formation includes decreasing the voltage for a period of time, preferably a short period of time. In one embodiment, the voltage is decreased for the duration of the command signal 70. The appropriate duration of the command signal 70 or amount of time is programmable and can be determined based on a variety of factors. For example, it may be appropriate to decrease the voltage or stop the supply of energy until a particular value or shape of voltage or current is observed, or until the frequency of the energy flowing through the system achieves a desirable pattern. Alternatively, the engine control unit (not shown) can determine the appropriate amount of time based on operating parameters.

The period of time may be for one oscillation period of the frequency of the energy flowing through the system, or may be for individual oscillation cycles at fixed internals, or may be for a portion of each oscillation cycle. In one embodiment, the period of time is not greater than microseconds. After the appropriate amount of time and at a certain decreased voltage, the arc formation can no longer be maintained and is extinguished.

When energy is provided to the corona igniter 22, some of the energy is stored in the ignition coil 27. Therefore, the step of decreasing the voltage includes dissipating the energy from the coil 27. This causes the voltage of the energy at the corona tip 28 of the corona igniter 22 to fall as the energy stored in the coil 27 is dissipated. In one embodiment, the step of decreasing the voltage includes extinguishing both the arcing and the corona discharge 20 for the short period of time.

Immediately after the arc formation is extinguished, the method includes increasing the voltage of the energy provided to the corona igniter 22. The increased voltage of energy is applied immediately after the step of decreasing the voltage applied to the corona igniter 22 for the period of time. Since it takes some time for the corona discharge 20 to grow large enough to reach a ground and form an arc again, there will be at least a period of time when the corona discharge 20 resumes. If the arcing occurs again, the system can again decrease the voltage of the energy provided to the corona igniter 22 to resume corona discharge 20. The control of the arcing can occur very fast and the cycle can repeat several times in one ignition event.

In one embodiment, after the period of time when the voltage is decreased and after the arc formation is extinguished, the method includes increasing the voltage to the same voltage initially provided to the corona igniter 22, before the period of time and before the onset of arc formation. For example, if the voltage initially provided to the corona igniter 22 is 40,000 volts, then the same 40,000 volts is again provided to the corona igniter 22. In another embodiment, a lower voltage is provided to the corona igniter 22 after the arc formation is extinguished. For example, if the voltage initially provided to the corona igniter 22 is 40,000 volts, then 30,000 volts is provided to the corona igniter 22 after the arc formation is extinguished. Alternatively, a higher voltage could be provided to the corona igniter 22 after the arc formation is extinguished.

In one exemplary embodiment, the energy supply 24 is turned on and the energy supplied to the corona igniter 22 is at a first voltage. When arcing is detected, the energy supply 24 is turned off completely so that the voltage provided to the corona igniter 22 is decreased to zero and both the arcing and corona discharge 20 are extinguished for the short period of time. After the short period of time, the energy supply 24 is turned back on and the energy supplied to the corona igniter 22 is at a second voltage, which is greater than the first voltage.

Figure 3:
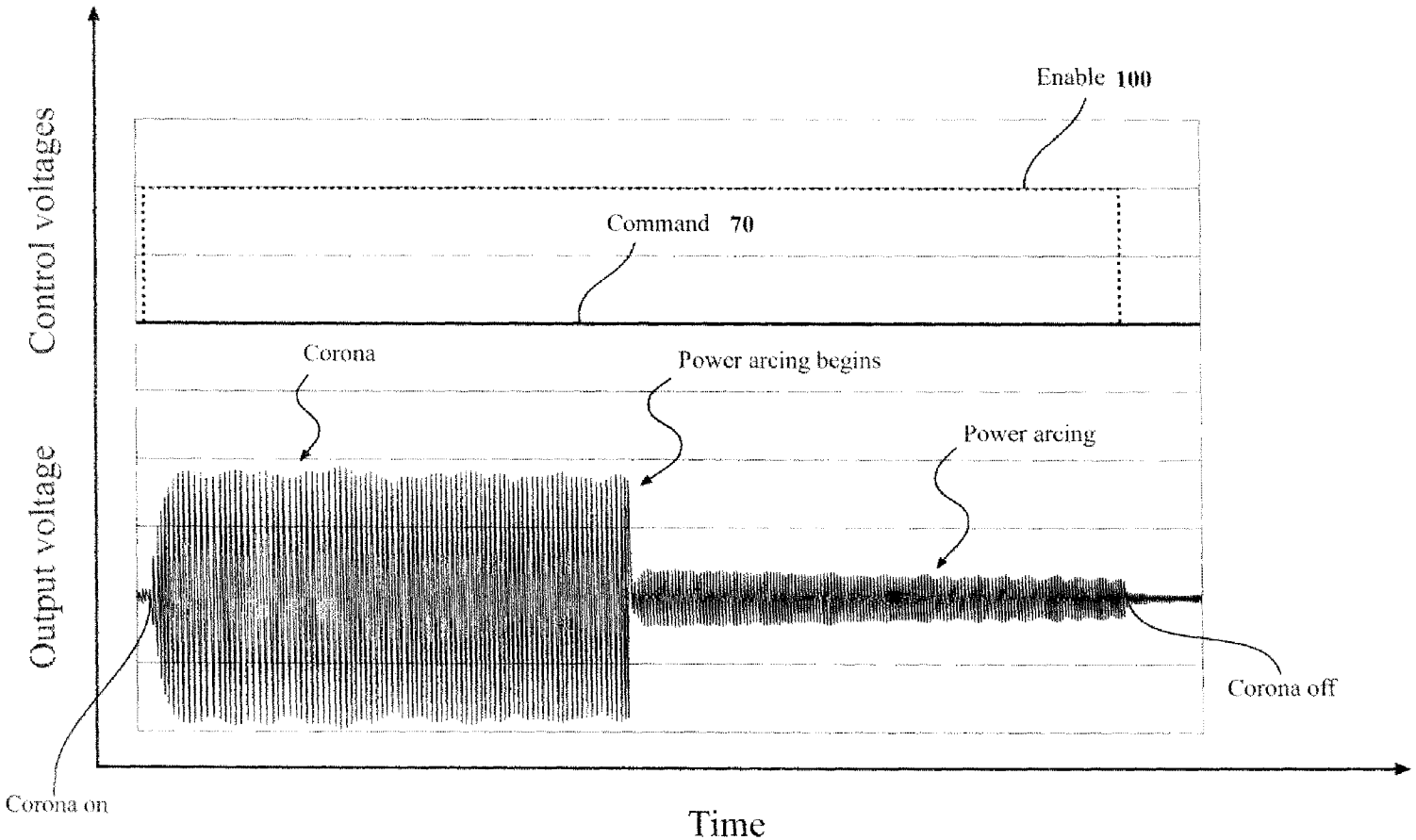
FIG. 3 includes a graph illustrating operation of a corona ignition system without the present invention.

FIG. 3 includes a graph illustrating operation of a corona ignition system without the present invention. The voltage at the corona tip 28 is provided over a period of time. The enable signal 54 is shown at 100 and the command signal 70 is not employed. The voltage rises as energy is provided to the corona igniter 22 and the corona discharge 20 forms. Eventually, the corona discharge 20 contacts a grounded component and switches to arcing. The graph shows a sharp decrease in the voltage at the onset and during the arcing.

Figure 4:
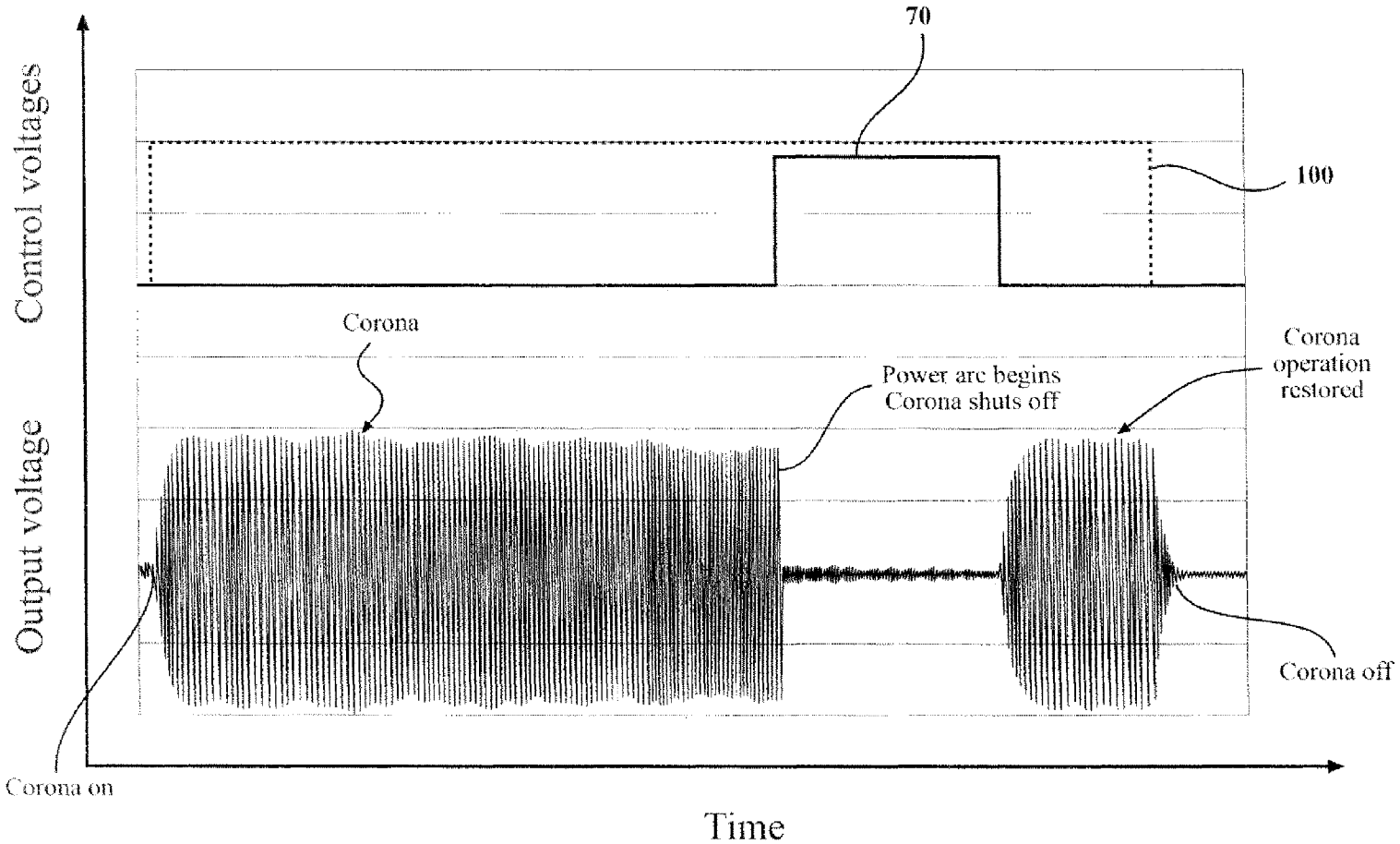
FIG. 4 includes a graph illustrating the advantage of operating the corona ignition system of FIG. 3 with the present invention.

FIG. 4 includes a graph illustrating operation with the present invention. The enable signal 54 is shown at 100 and the command signal 70 is employed. The voltage rises as energy is provided to the corona igniter 22 and the corona discharge 20 forms. Eventually, the corona discharge 20 contacts a grounded component and switches to arcing, and the voltage decreases sharply. However, when the arc formation occurs, the command signal 70 is transmitted from the corona controller 26 to the main controller 26 and the voltage of the energy supply 24 is decreased. The command signal 70 is transmitted for a predetermined period of time, which is until the arcing is extinguished. At that point, the command signal 70 ends, voltage increases, and the corona discharge 20 resumes.

Obviously, many modifications and variations of the present invention are possible in light of the above teachings and may be practiced otherwise than as specifically described while within the scope of the appended claims.

What is claimed is:

1. A method for controlling an arc formation in corona discharge ignition system, comprising:

providing energy to a corona igniter at a voltage;

detecting an arc formation while providing the energy to the corona igniter; and ceasing the step of providing energy to the corona igniter in response to the arc formation.

2. The method of claim 1 wherein ceasing the step of providing energy to the corona igniter includes providing no energy to the corona igniter for a period of time.

3. The method of claim 2 wherein the period of time is not greater than microseconds.

4. The method of claim 2 including increasing the voltage of the energy provided to the corona igniter immediately after the period of time.

5. The method of claim 4 wherein the voltage of the energy provided to the corona igniter before the period of time is at a first voltage, and the step of increasing the voltage of the energy after the period of time includes providing the energy at a second voltage being less than the first voltage.

6. The method of claim 2 wherein the period of time is equal to one oscillation period of the frequency of the energy provided to the corona igniter or a portion of the one oscillation period.

7. The method of claim 1 wherein the step of providing energy to the corona igniter includes providing energy to a coil of the corona igniter and storing the energy in the coil, and the step of ceasing the energy provided to the corona igniter includes dissipating the energy from the coil.

8. The method of claim 1 wherein the arc formation is unintentional.

9. The method of claim 1 including providing a corona discharge prior to the arc formation.

10. The method of claim 1 wherein ceasing the step of providing energy to the corona igniter includes decreasing the voltage to zero.

11. The method of claim 1 wherein the voltage provided to the corona igniter before the ceasing step is at a first voltage, the ceasing step includes providing no energy to the corona igniter for a first period of time, and further including providing energy to the corona igniter at a second voltage immediately after the first period of time, wherein the second voltage is less than the first voltage.

12. The method of claim 1 including forming a corona discharge while providing the energy to the corona igniter; allowing the arc to fully form prior to the detecting step; and the step of ceasing the energy provided to the corona igniter including providing no energy to the corona igniter and extinguishing the arc formation and the corona discharge for a period of time, the period of time being microseconds; and providing energy to the corona igniter immediately after the period of time to form another corona discharge.

13. The method of claim 1 including supplying energy to a driver circuit connected to the corona igniter and oscillating at a resonant frequency; and wherein the step of detecting the arc formation includes obtaining a resonant frequency of the energy in the oscillating driver circuit; and identifying a variation in an oscillation period of the resonant frequency.

14. A system for controlling an arc formation in corona discharge ignition system, comprising:

a corona igniter for receiving energy at a voltage and providing a corona discharge;

an energy supply for providing the energy to the corona igniter; and a corona controller for ceasing the step of providing energy to the corona igniter in response to detection of an arc formation.

15. The system of claim 14 including a differential amplifier for receiving energy from the energy supply and amplifying the energy and providing the amplified energy to the corona igniter, and wherein the corona controller ceases the step of providing energy to the corona igniter by preventing the differential amplifier from providing the energy to the corona igniter.

16. The system of claim 14 including a main controller providing an enable signal allowing the energy supply to provide the energy to the corona igniter and wherein the corona controller ceases the step of providing energy to the corona igniter by stopping the enable signal.

17. The system of claim 14 including a driver circuit connected to the corona igniter and oscillating at a resonant frequency; and a frequency monitor for detecting the arc formation by identifying a variation in an oscillation period of the resonant frequency.

* * * * *

UNITED STATES PATENT AND TRADEMARK OFFICE

CERTIFICATE OF CORRECTION

PATENT NO. : 8,760,067 B2
APPLICATION NO. : 13/438127
DATED : June 24, 2014
INVENTOR(S) : John Anthony Burrows It is certified that error appears in the above-identified patent and that said Letters Patent is hereby corrected as shown below:

In the Specification

Column 2, line 32: "an calibration" should read – "an existing corona discharge ignition system, without the need for complex digital components, calibration."

Signed and Sealed this
Twenty-fifth Day of November, 2014

Michelle K. Lee

Michelle K. Lee
*Deputy Director of the United States Patent and Trademark Office*